US011975895B2

(12) United States Patent
Song

(10) Patent No.: US 11,975,895 B2
(45) Date of Patent: May 7, 2024

(54) MULTI-PURPOSE CONTAINER

(71) Applicant: Sysler Corporation, Irvine, CA (US)

(72) Inventor: Stella Song, Irvine, CA (US)

( * ) Notice: Subject to any disclaimer, the term of this patent is extended or adjusted under 35 U.S.C. 154(b) by 40 days.

(21) Appl. No.: 17/495,812

(22) Filed: Oct. 6, 2021

(65) Prior Publication Data

US 2023/0105069 A1 Apr. 6, 2023

(51) Int. Cl.

| | |
|---|---|
| ***B65D 1/02*** | (2006.01) |
| ***B65D 41/26*** | (2006.01) |
| ***B65D 47/04*** | (2006.01) |
| ***B65D 47/28*** | (2006.01) |
| ***B65D 51/18*** | (2006.01) |
| ***B65D 51/24*** | (2006.01) |

(52) U.S. Cl.

CPC ..... *B65D 47/043* (2013.01); *B65D 1/0207* (2013.01); *B65D 41/26* (2013.01); *B65D 47/286* (2013.01); *B65D 51/18* (2013.01); *B65D 51/24* (2013.01); *B65D 2251/0015* (2013.01); *B65D 2251/0087* (2013.01)

(58) Field of Classification Search

CPC .... B65D 47/043; B65D 1/0207; B65D 41/26; B65D 47/286; B65D 51/18; B65D 2251/0015; B65D 2251/0087; B65D 51/24

See application file for complete search history.

(56) References Cited

U.S. PATENT DOCUMENTS 3,994,522 A * 11/1976 Hinshaw ..... A47J 43/28 220/203.16
4,006,837 A * 2/1977 Gates ..... B65D 41/0471 220/293
4,274,563 A * 6/1981 Otterson ..... B65D 17/404 222/541.6
4,526,293 A * 7/1985 Kramer ..... B65D 83/0409 222/476
4,613,063 A * 9/1986 Wright ..... B65D 55/02 222/548
5,601,213 A * 2/1997 Daniello ..... G01F 11/261 222/456
6,283,339 B1 * 9/2001 Morrow ..... G01F 23/24 222/548
6,550,640 B2 * 4/2003 Smith ..... G01F 11/24 222/430
6,966,468 B2 * 11/2005 McKay ..... B65D 83/06 222/548
7,513,399 B2 * 4/2009 Mengeu ..... B65D 47/265 222/575
9,371,164 B2 * 6/2016 Cavalier ..... B65D 47/265
9,969,538 B1 * 5/2018 Carr ..... B65D 47/043

(Continued)

*Primary Examiner* — Frederick C Nicolas

(57) ABSTRACT

The present invention provides a multi-purpose container configured to retain granulate material for short- or long-term use. Furthermore, the present invention will provide various rates of flow to access the granulate material at a rate suitable for the user. This is accomplished through a container body, a removable cap, and a measuring cup. The removable cap further includes a plurality of spouts and is configured to removably attach to the container body, while the measuring cup is configured to removably attach to the removable cap. These components work in conjunction to form a multi-purpose container configured to facilitate the pouring of the material held within the container body at a desired flow rate.

17 Claims, 6 Drawing Sheets

(56) References Cited

U.S. PATENT DOCUMENTS

| | | | | |
|---|---|---|---|---|
| 10,160,576 | B2 * | 12/2018 | Grunert | B65D 47/265 |
| 2008/0087690 | A1 * | 4/2008 | Parve | B65D 47/265<br>222/545 |
| 2015/0041423 | A1 * | 2/2015 | Schmertz, Jr. | B65D 83/06<br>215/43 |
| 2016/0046414 | A1 * | 2/2016 | Grell | B65D 43/0202<br>53/492 |
| 2019/0106253 | A1 * | 4/2019 | Ludewig | G01F 11/261 |
| 2021/0031983 | A1 * | 2/2021 | Azelton | B65D 1/0246 |

* cited by examiner

MULTI-PURPOSE CONTAINER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to a multi-purpose container, and more particularly, to an apparatus for easily containing and dispensing a granulate material with varying rates of flow.

DISCUSSION OF RELATED ART

A container can generally be described as a receptacle for holding or transporting goods. A jar is a type of container with a generally cylindrical shape and traditionally made of glass or other transparent material. Jars typically have removable tops to enable the easy opening and sealing of the goods inside. As such, jars are often used for the short-term storage of goods that are periodically used, such as in a kitchen where ingredients must be isolated and stored but also must be easily accessible for use.

While various containers and jars exist in the prior art for the short-term storage of goods, there is a continued need for a durable and versatile multi-purpose container that combines the advantages of long-term storage containers while still offering easy access to the goods inside. Furthermore, there is a continued need for a multi-purpose container that can quickly and easily provide various rates of flow while still maintaining the integrity of the goods inside. The present invention satisfies these needs.

SUMMARY OF THE INVENTION

The present invention will provide a multi-purpose container configured to retain granulate material for short- or long-term use. Furthermore, the present invention will provide various rates of flow to access the granulate material at a rate suitable for the user. This is accomplished through a container body, a removable cap, and a measuring cup. The removable cap further comprises a plurality of spouts and is configured to removably attach to the container body, while the measuring cup is configured to removably attach to the removable cap. These components work in conjunction to form a multi-purpose container configured to facilitate the pouring of the material held within the container body at a desired flow rate.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
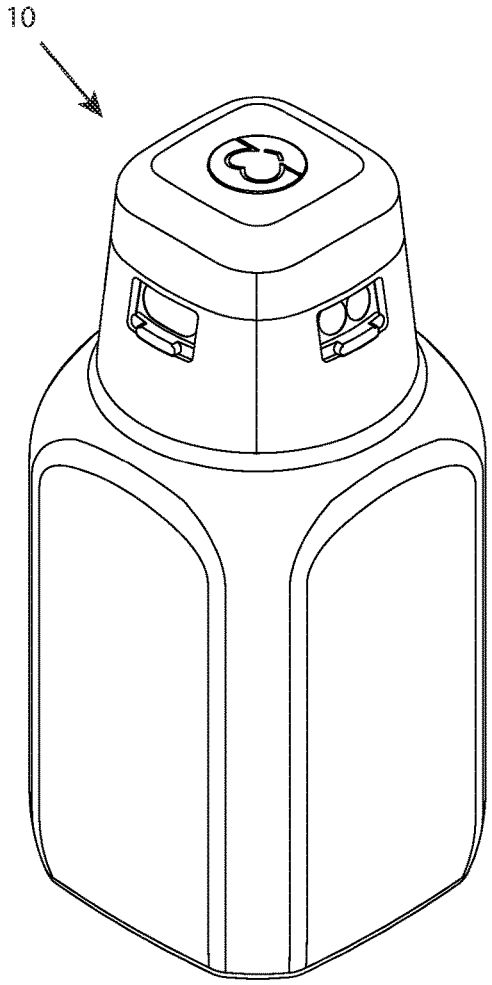
FIG. 1 is a front isometric view of the multi-purpose container according to one embodiment of the present invention.
Figure 2:
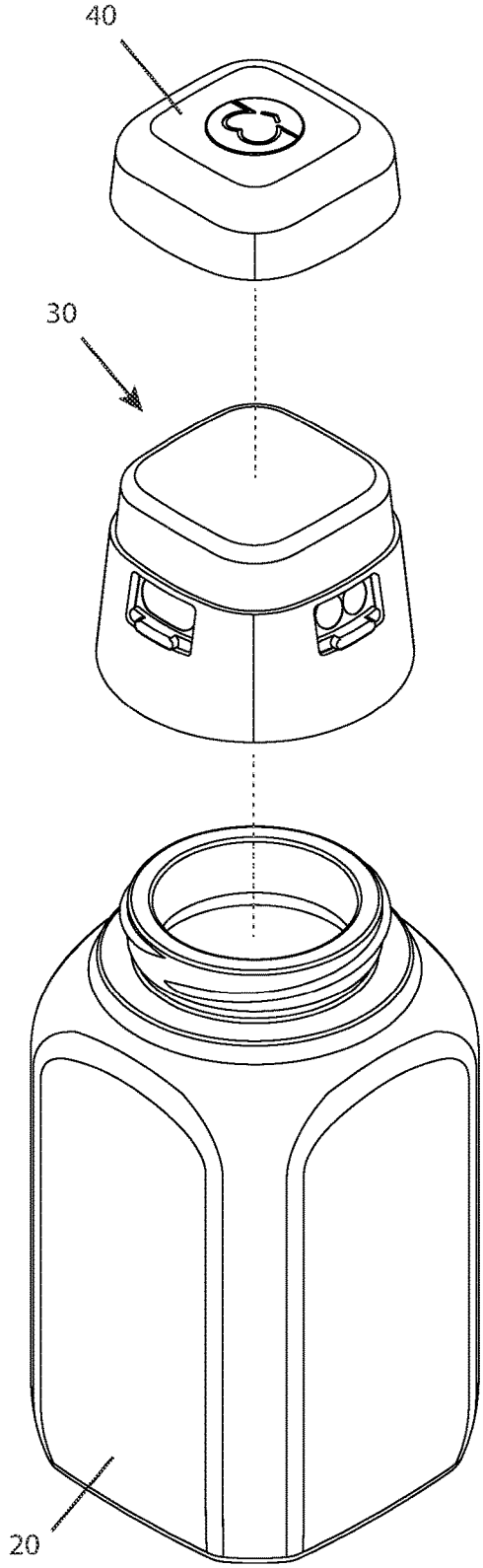
FIG. 2 is an exploded front isometric view therein showing the container body, removable cap, and measuring cup.
Figure 3:
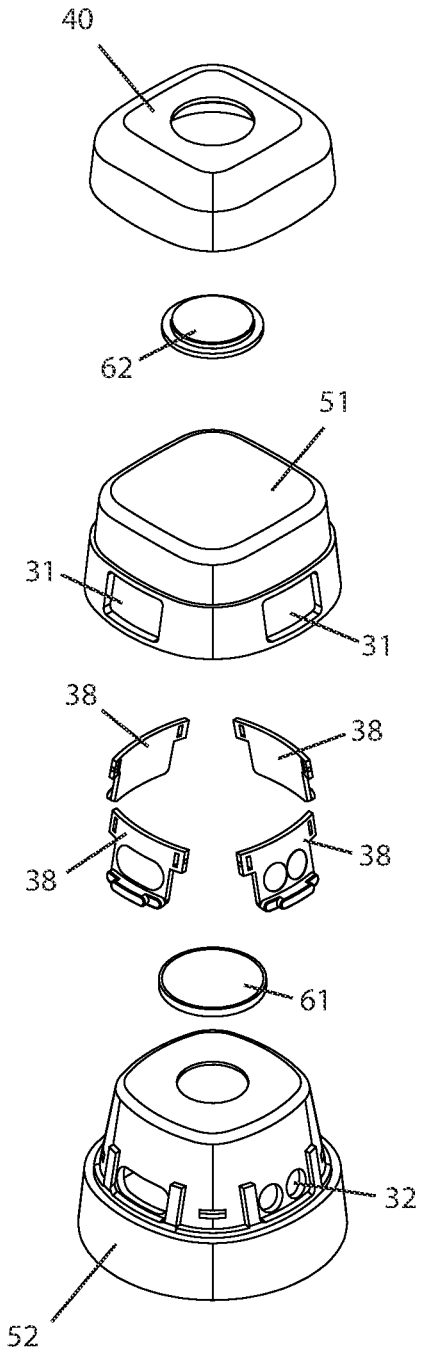
FIG. 3 is an exploded front isometric view showing removable cap in more detail.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The multi-purpose container 10 comprises a container body 20, a removable cap 30, and a measuring cup 40. The removable cap 30 further comprises a plurality of apertures 31 and is configured to removably attach to the container body 20, while the measuring cup 40 is configured to removably attach to the removable cap 30. These components work in conjunction to form a multi-purpose container 10 configured to facilitate the pouring of granulate material held within the container body 20 at a desired flow rate. Each component will be described in detail below.

The container body 20 comprises a compartment for storing a granulate material. More specifically, the container body 20 will store spices, powders, cleaning materials, arts and craft materials, and other granulate material that is traditionally stored in a container. The container body 20 comprises an opening at its top and further comprises a threaded portion about said opening. In a preferred embodiment, the container body 20 has a generally square shape and further comprises a durable and translucent material such as tempered glass.

The removable cap 30 is configured to removably attach to the container body 20. More specifically, the removable cap 30 engages with the threaded portion of the container body 20, capping and sealing the container body 20 and granulate material once engaged. In the preferred embodiment, the removable cap 30 has a generally square shape and comprises a sturdy material such as ABS plastic.

The removable cap 30 further comprises a means for pouring said granulate material at a desired flowrate. This is accomplished through a plurality of apertures 31 positioned about the removable cap 30, with each aperture 31 providing a different flowrate. The apertures 31 are in fluid communication with the container body 20 when the removable cap 30 is attached to the container body 20, and as such, provide a means to release the granulate material from the device 10.

Figure 5:
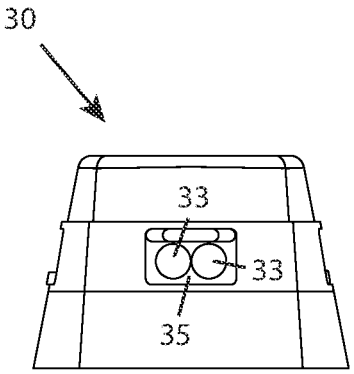
FIG. 5 is a side view of the removable cap showing a second aperture with filter.
Figure 6:
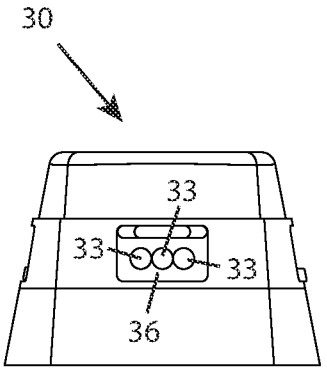
FIG. 6 is a side view of the removable cap showing a third aperture with filter.
Figure 7:
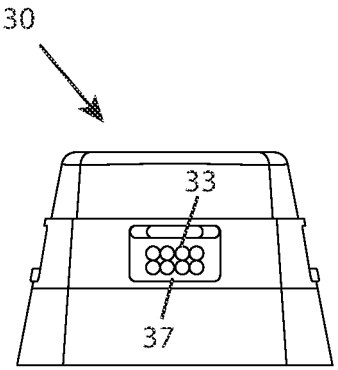
FIG. 7 is a rear view of the removable cap showing a fourth aperture.
Figure 8:
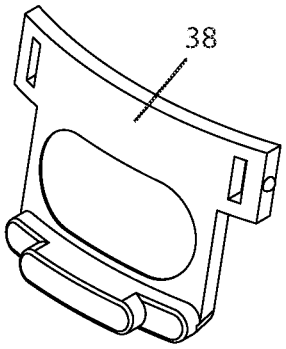
FIG. 8 is a front view of the removable cap showing a first cover.
Figure 9:
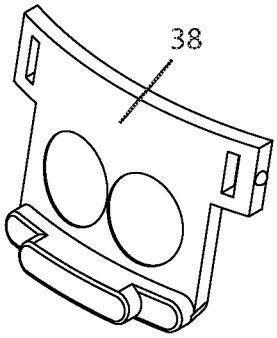
FIG. 9 is a front view of the removable cap showing a second cover.
Figure 10:
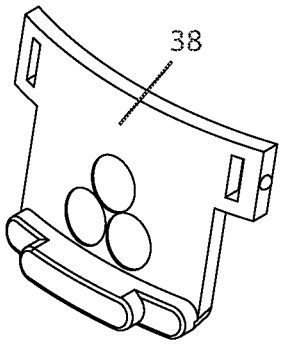
FIG. 10 is a front view of the removable cap showing a third cover.
Figure 11:
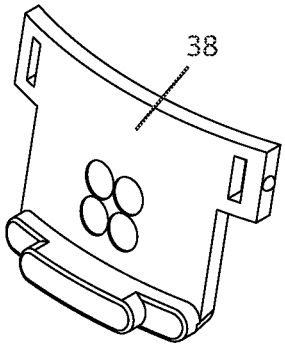
FIG. 11 is a front view of the removable cap showing a fourth cover.
Figure 12:
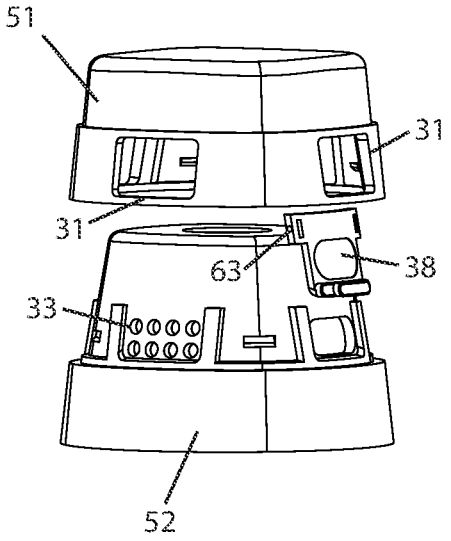
FIG. 12 is an isometric exploded view of the removable cap.

Each aperture 31 is configured to provide a different flowrate, where the user will select a specific aperture 31 to pour the granulate material due to their respective flowrates. The highest flowrate is provided by an unobstructed aperture 31. A reduced flowrate is provided by affixing a filter 32 onto said aperture 31, wherein the filter may have a plurality of perforations 33. In the preferred embodiment, the number of perforations 33 ranges between two-eight, and the size of each perforation 33 is inversely proportional to the number of perforations 33 on each filter (see FIGS. 5-7). The higher the number of perforations 33, the lower the flowrate provided by that aperture 31. In the preferred embodiment, the size of each perforation ranges between 0.5 mm-5 mm.

Figure 4:
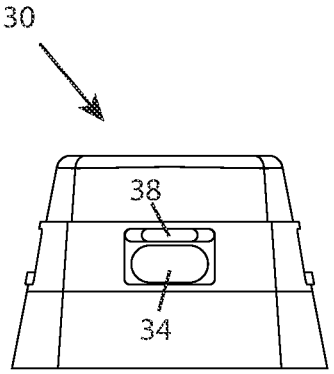
FIG. 4 is a front view of the removable cap showing a first aperture.

As an exemplary embodiment, the removable cap 30 further comprises a cap base 51 and a cap cover 52, which combine to form the removable cap 30 with a generally square-shape with rounded corners and further comprising four apertures 31 positioned on each side, providing four different flowrates. Here, a first aperture 34 (FIG. 4) provides the highest flowrate, while a second aperture 35 (FIG. 5) is configured with a filter 32 having two perforations 33, providing a reduced flowrate. A third aperture 36 (FIG. 6) is configured with a filter 32 having three perforations 33 and thus provides an even lower flowrate, while a fourth aperture 37 (FIG. 7) is configured with a filter 32 having eight perforations 33, thus providing the lowest flowrate.

Figure 13:
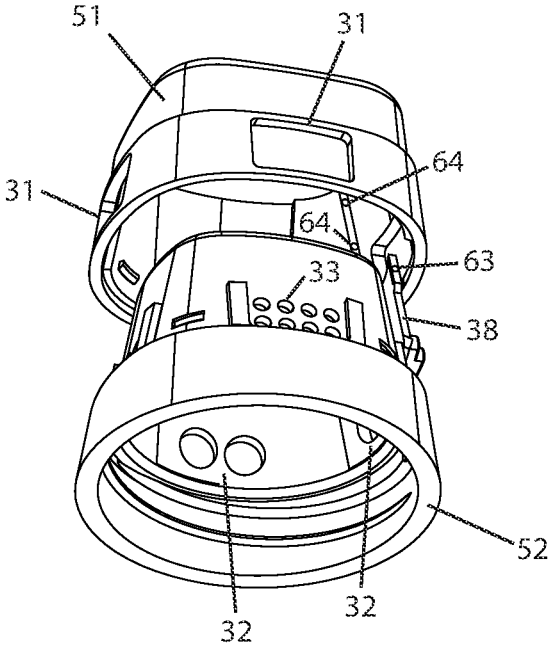
FIG. 13 is an isometric exploded view of FIG. 12 showing a different angle showing the protrusions and cavities of the covers.
Figure 14:
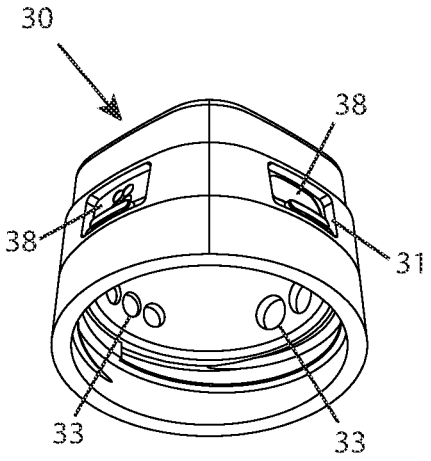
FIG. 14 is a front bottom isometric view of the removable cap according to one embodiment of the present invention.
Figure 15:
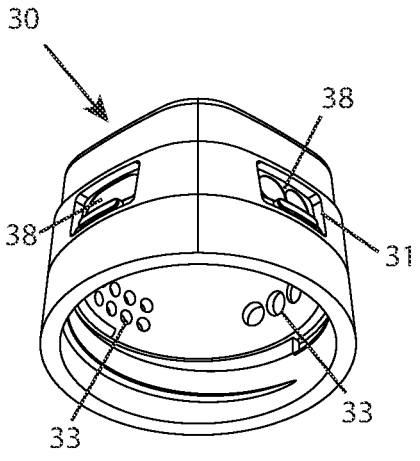
FIG. 15 is a rear bottom isometric view of the removable cap thereof.

Each aperture 31 is further configured with a cover 38 positioned between the cap base 51 and cap cover 52 adjacent to the respective aperture 31 and configured to obstruct said apertures 31. More specifically, the covers 38 are slidably attached to the removable cap 30 and move perpendicularly relative to said apertures 31, and each cover 38 can be lowered (opened) or raised (closed) to cover or uncover their respective apertures 31. Each cover 38 further comprises a pair of opposing protrusions 63 that are configured to align with a pair of opposing cavities 64 located on the cap cover 52 (See FIG. 13). Here, the protrusions 63 are configured to engage with the cavities 64 when the covers 38 are lowered into a closed position, helping to ensure the covers 38 remain in this position. While these orientations are used in the preferred embodiment, any orientation can be used to open and close the covers 38 (ie. the covers 38 can be lowered to close the apertures 31 and raised to open the apertures 31).

When in a closed position, the covers 38 obstruct the apertures 31 and stop the flow of granulate material from the container body 20 to the outside. This further provides a means for pouring from a desired aperture 31 and only from that aperture 31. When in an open position, the covers 38 unobstruct the apertures 31 and permit the flow of granulate material from the container body 20 to the outside. The covers 38 are frictionally attached to the removable cap 20 such that they can remain fully closed, fully open, half open, or anywhere in between. This further enables the user to fine-tune the flowrate as desired by allowing the cover 38 to partially obstruct the apertures 31 and/or perforations 33.

Each cover 38 further comprises a marking for displaying the size and shape of the associated aperture 31, filter 32, and perforations 33 such that the user can identify the flowrate without opening the cover 38 (See FIGS. 8-11, where each cover 38 has a marking showing the general size of the perforations 33 associated with that aperture 31). In an alternative embodiment, each aperture 31 further comprises a spout or lip for assisting in pouring.

Figure 16:
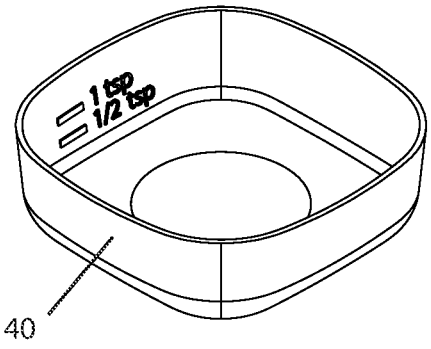
FIG. 16 is an isometric view of the measuring cup according to one embodiment of the present invention.

The measuring cup 40 is configured to removably attach to the removable cap 20 positioned above the apertures 31. More specifically, the measuring cup 40 comprises a measuring cup magnet 62 configured to magnetically attach to a removable cap magnet 61 of the opposite polarity positioned in the removable cap 20, wherein said magnets 61, 62 are of sufficient strength to ensure that the measuring cup 40 does not become dislodged when shaking or pouring said granulate material from the device 10. The measuring cup 40 doubles as a pinch bowl and as a means for measuring said granulate material, as is often necessary when cooking. As such, the measuring cup 40 comprises a plurality of marks for measuring said granulate material. As an example, the measuring cup 40 comprises a plurality of markings associated with measuring volume (mL, fl oz, tsp, tbsp, etc., See FIG. 16). The measuring cup 40 further comprises the same durable material that the removable cap is made from, such as ABS plastic or the like.

While the above description contains specific details regarding certain elements, sizes, and other teachings, it is understood that embodiments of the invention or any combination of them may be practiced without these specific details. Specifically, although certain materials, shapes, shapes and orientations are described and shown in the above embodiments and drawings, any suitable material, shape, or orientation may be used. These details should not be construed as limitations on the scope of any embodiment, but merely as exemplifications of the presently preferred embodiments. In other instances, well known structures, elements, and techniques have not been shown to clearly explain the details of the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A multi-purpose container comprising:

a container body configured to retain a granulate material;

a removable cap configured to provide a seal when attached to said container body;

a plurality of apertures positioned about said removable cap, said plurality of apertures in fluid communication with said container body, wherein said plurality of apertures are configured to release said granulate material from said container body; and a plurality of covers positioned adjacent to each of said plurality of apertures and slidably attached to said removable cap, wherein any aperture can be opened or closed by raising or lowering said cover;

wherein each of said plurality of apertures has a different flowrate.

2. The multi-purpose container of claim 1, wherein said removable cap further comprises a cap base and a cap cover, wherein said plurality of apertures are positioned on said cap base.

3. The multi-purpose container of claim 2, wherein said cap cover further comprises a plurality of filters aligned with and in fluid communication with said plurality of apertures, wherein each of said plurality of filters partially obstructs each of said plurality of apertures.

4. The multi-purpose container of claim 3, wherein said plurality of filters each further comprise a plurality of perforations, wherein the higher the number of perforations, the smaller the size of each perforation, and wherein the higher number of perforations, the lower the flowrate.

5. The multi-purpose container of claim 4, wherein the number of perforations ranges between two and four perforations and wherein the size of each perforation ranges between 0.5 mm-5 mm.

6. The multi-purpose container of claim 1, wherein said covers further comprises a closed position and an open position, wherein said closed position comprises obstructing said aperture with said cover, and wherein said open position further comprises unobstructing said aperture with said cover.

7. The multi-purpose container of claim 6, wherein said plurality of covers are slidably and frictionally attached to said removable cap, wherein said friction enables said plurality of covers to remain half-open, fully open, fully closed, or anywhere in between.

8. The multi-purpose container of claim 7, wherein said plurality of covers further comprise a pair of opposing protrusions and said removable cap further comprises a pair of opposing cavities, wherein said pair of opposing protrusions are configured to engage with said pair of opposing cavities in said closed position.

9. The multi-purpose container of claim 1, wherein said covers move perpendicularly relative to said apertures.

10. The multi-purpose container of claim 1, wherein said removable cap further comprises a plurality of sides, and wherein an aperture is positioned on each side.

11. The multi-purpose container of claim 10, wherein said apertures are positioned at the center of each side and aligned with one another horizontally along the same plane.

12. The multi-purpose container of claim 1, further comprises a measuring cup, said measuring cup removably attached to said removable cap.

13. The multi-purpose container of claim 12, wherein said measuring cup further comprising a plurality of marks for measuring said granulate material.

14. The multi-purpose container of claim 12, wherein said measuring cup and said removable cap further comprise a pair of opposing magnets and wherein said measuring cup is magnetically attached to said removable cap.

15. The multi-purpose container of claim 1, wherein said container body further comprises a threaded portion, and wherein said removable cap engages with said container body with said threaded portion.

16. The multi-purpose container of claim 1, wherein said container body further comprises a durable and translucent material.

17. The multi-purpose container of claim 1, wherein said removable cap further comprises a sturdy material.

* * * * *